United States Patent [19]

Kobayashi

[11] Patent Number: 4,754,970

[45] Date of Patent: Jul. 5, 1988

[54] GOLF CLUB SET

[75] Inventor: Masashi Kobayashi, Matsudo, Japan

[73] Assignee: Maruman Golf Co., Ltd., Tokyo, Japan

[21] Appl. No.: 942,325

[22] Filed: Dec. 16, 1986

[30] Foreign Application Priority Data

Dec. 17, 1985 [JP] Japan ..... 60-281876

[51] Int. Cl.[4] ..... A63B 53/04; A63B 53/08

[52] U.S. Cl. ..... 273/77 A; 273/175

[58] Field of Search ..... 273/77 A, 173, 167 J, 273/167 F, 167 H, 167 K, 168, 169, 170, 171, 172, 174, 175, 78

[56] References Cited

U.S. PATENT DOCUMENTS 3,455,558 7/1969 Onions ..... 273/77 A 3,984,103 10/1976 Nix ..... 273/77 A

FOREIGN PATENT DOCUMENTS 21938 2/1977 Japan ..... 273/173

OTHER PUBLICATIONS

"The Search for a Perfect Swing", 1968, J. B. Lippincott Co., Philadelphia and New York, pp. 152–155.

*Primary Examiner*—George J. Marlo

*Attorney, Agent, or Firm*—Armstrong, Nikaido, Marmelstein & Kubovcik

[57] ABSTRACT

A golf club set comprising a series of golf clubs, each having a hitting surface for hitting a two-piece type golf ball. The hitting surface of each club of the set having a loft angle increasing in angle relative to the loft angle of the immediately preceding club in the set. The hitting surface of the lowest loft angle club in the set having a loft angle larger than 40°. The hitting surface of each of the golf clubs in the set having different coefficients of friction and the coefficient of friction increases with the increase in loft angle.

3 Claims, 5 Drawing Sheets

GOLF CLUB SET

BACKGROUND OF THE INVENTION (1) Field of the Invention

The present invention relates to a set of golf clubs. More particularly, the present invention relates to a set of golf clubs suitable for both yarn-wound balls and two-piece balls.

(2) Description of the Related Art

In playing golf, when an approach shot is made around the green, a precise fly distance shot is ordinarily required to facilitate a subsequent putter shot. Accordingly, a set of golf clubs for an approach shot has been developed. For example, an approach club set comprising three clubs is used. In this golf club set, the three clubs have the same length but the loft angle of the clubs is gradually increased. Namely, the first club is used for an approach shot of about 90 m; the second club is used for an approach shot of about 60 m; and the third club is used for an approach shot of about 30 m.

When a yarn-wound ball is hit by any of these approach clubs, the spin of the ball is increased in proportion to the increase of the loft angle, because of the characteristics of the ball, and therefore, a desired trajectory is obtained and the ball stop property [(run/carry)×100 (%)] is the same for all of the clubs. Accordingly, if an appropriate club is selected, an approach shot having an intended fly distance can be obtained.

But, where a recently developed two-piece ball is used, the contact time between the ball and the club head is shorter than in case of the yarn-wound ball, and therefore, even if a club having a large loft angle is used, a ball spin proportional to the loft angle cannot be obtained. Accordingly, the ball stop property is degraded and a precise approach shot cannot be made. This phenomenon is especially conspicuous in clubs having a loft angle larger than 40°, and has been practically confirmed that the degradation of the ball stop property becomes more conspicuous with each increase in the loft angle. Accordingly, golfers regarding approach shots as being important dislike two-piece balls.

SUMMARY OF THE INVENTION

A primary object of the present invention is to provide a golf club set which ensures an optimum ball stop property in an approach shot when either a yarn-wound ball or a two-piece ball is used.

In accordance with the present invention, this object can be attained by a golf club set comprising a plurality of golf clubs, each provided with a head having a face portion for hitting a golf ball, wherein the friction coefficient of the face portion of the head of at least one golf club is larger than those of the face portions of the heads of the other clubs.

In the golf club set of the present invention, a golf club having a larger friction coefficient at the face portion of the head thereof or a golf club having a small friction coefficient at the face portion of the head thereof is appropriately selected and used according to the kind of the ball in use and the intended fly distance, whereby an optimum ball stop property can be obtained.

The foregoing and other objects and advantages of the present invention will be better understood from the following description with reference to the preferred embodiments illustrated in the drawings.

DESCRIPTION OF THE PREFERRED EMBODIMENTS

Figure 1:
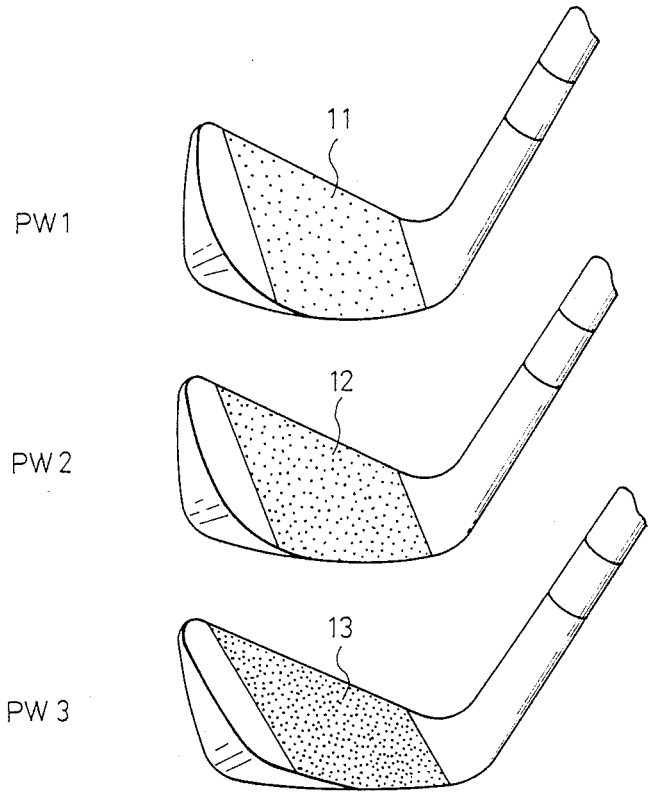
FIG. 1 is a perspective view showing the main parts of the respective clubs in the first embodiment, in which the present invention is applied to a golf club set comprising three approach shot golf clubs.

FIG. 1 illustrates the first embodiment of the present invention. In this embodiment, the golf club set comprises three iron clubs PW1 through PW3 used exclusively for approach shots, and generally called "pitching wedges". In this set, the clubs PW1 through PW2 have the same head weight (for example 290 g) and club balance (for example, class D1), so that all of the clubs can be swung substantially with the same feeling. Furthermore, the clubs PW1 through PW3 have the same length (for example, about 88.9 cm). Note, the length of the club may be gradually increased as the club number becomes higher. In this set, the loft angle is gradually increased, preferably at a certain ratio, in the order of clubs PW1, PW2, and PW3 (for example, 50°, 55°, and 60°). Furthermore, the friction coefficient $\mu$ of the face portion 13 of the head of the club PW3 is larger than the friction coefficients $\mu$ of the face portions 11 and 12 of the heads of the other clubs PW1 and PW2, and the friction coefficients $\mu$ of the face portions 11, 12, and 13 are gradually increased in the order of clubs PW1, PW2, and PW3. As schematically shown in FIG. 1, in the present embodiment, fine convexities and concavities are formed on the front faces of the face portions 11 through 13 of the clubs PW1 through PW3 by a shot blast treatment, and the shot blast treatment conditions are changed for each club so that the surface roughness is gradually increased in the order of the face portions 11, 12, and 13 of the clubs PW1, PW2, and PW3.

Figure 2:
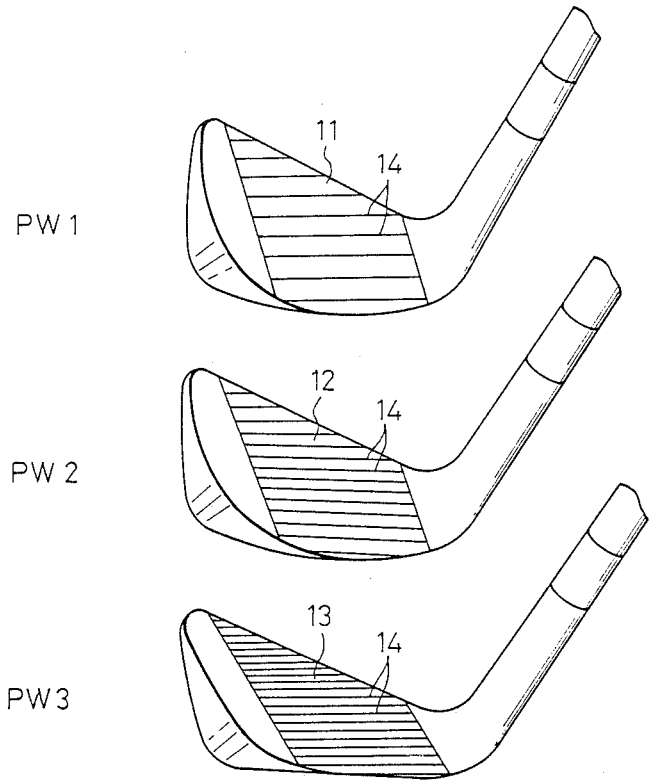
FIG. 2 is a perspective view illustrating the main parts of the respective clubs in an approach shot golf club set according to the second embodiment of the present invention.
Figure 3:
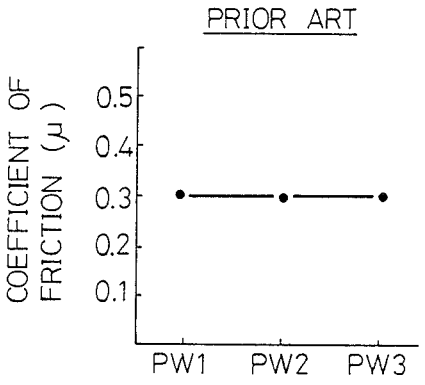
FIG. 3 is a graph showing the friction coefficients of face portions of the heads of the respective clubs in the conventional approach shot golf club set.
Figure 4:
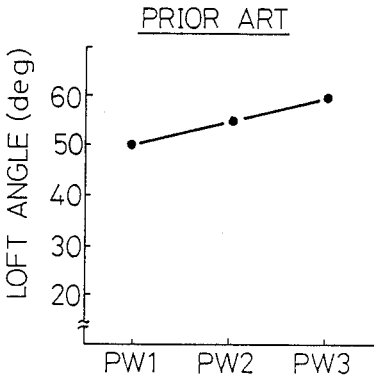
FIG. 4 is a graph showing the loft angles of the respective clubs of the conventional approach shot golf club set.

FIG. 2 illustrates the second embodiment of the present invention. In this embodiment, grooves 14 are formed substantially in parallel to the sole on each of face portions 11 through 13 of the heads of clubs PW1 through PW3, and the number of grooves 14 for each club is changed so that the friction coefficient $\mu$ of the face portion 13 of the club PW3 is larger than the friction coefficients $\mu$ of the face portions 11 and 12 of the heads of other clubs PW1 and PW2, and the friction coefficients $\mu$ of the face portions 11, 12, and 13 are gradually increased in the order of the clubs PW1, PW2 and PW3. Other structual features are the same as in the first embodiment. Accordingly, the golf club set shown in FIG. 1 and the golf club set shown in FIG. 2 have the same ball-hitting characteristics.

FIGS. 3 through 6 show the mechanical characteristics and ball-hitting characteristics of three clubs PW1 through PW3 in the conventional approach shot golf club set. FIGS. 7 through 10 show the mechanical characteristics and ball-hitting characteristics of the above-mentioned clubs PW1 through PW3 of the present invention. As is seen from FIGS. 4 and 8, the loft angles of the respective clubs PW1 through PW3 are the same for the conventional set and the set of the present invention, so that a precise comparison can be made. In the conventional clubs PW1 through PW3, as seen from FIG. 3, the friction coefficients $\mu$ of the face portions of the heads are substantially equal and about 0.3. In contrast, in the clubs PW1 through PW3 of the present invention, as seen from FIG. 7, the friction coefficients $\mu$ are increased from 0.35 to 0.45 in the order of PW1, PW2, and PW3.

Figure 5:
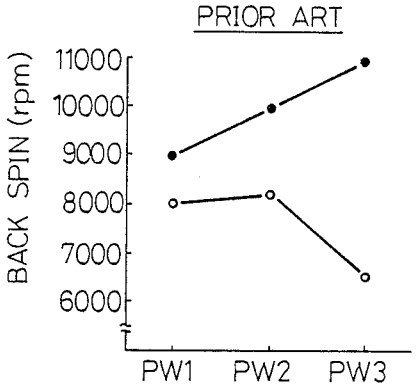
FIG. 5 is a graph showing the ball back spin obtained by the respective clubs of the conventional approach shot golf club set.

FIG. 5 shows ball back spin (rpm) obtained by using the conventional clubs PW1 through PW3. In FIG. 5, the mark "•" shows the back spin obtained when a yarn-wound ball is hit, and the mark "o" shows the back spin obtained when a two-piece ball is hit. As seen from FIG. 5, when a yarn-wound ball is used, the ball back spin is increased substantially proportionally, that is, linearly, with the increase in the club number. But, in case of a two-piece ball, the ball back spin is greatly reduced, especially in the case of the club PW3.

Figure 9:
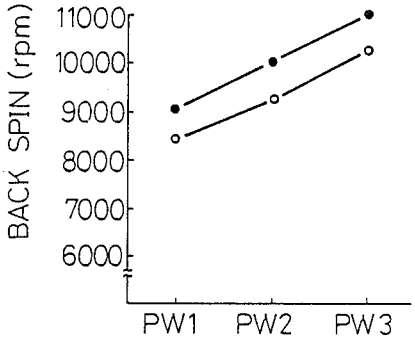
FIG. 9 is a graph showing the ball back spin obtained by the respective clubs in the approach shot golf club set of the present invention.

FIG. 9 shows the ball back spin (rpm) obtained by using the clubs PW1 through PW3 of the present invention. In FIG. 9, the mark "•" shows the back spin obtained when a yarn-wound ball is hit, and the mark "o" shows the back spin obtained when a two-piece ball is hit. As is seen from FIG. 9, the ball back spin is increased at almost an equal ratio to the increase of the club number in the case of either a yarn-wound ball or a two-piece ball.

Figure 6:
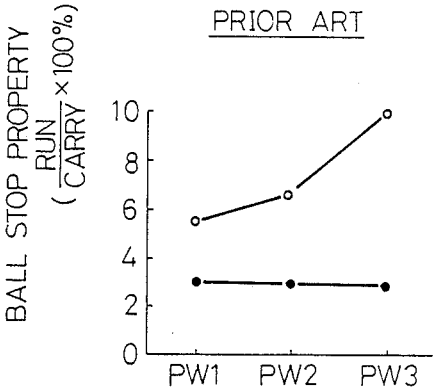
FIG. 6 is a graph showing the ball stop properties obtained by the respective clubs of the conventional approach shot golf club set.
Figure 7:
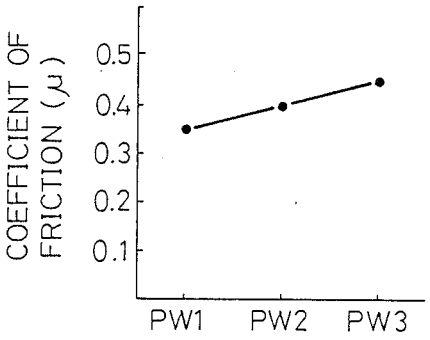
FIG. 7 is a graph showing the friction coefficients of face portions of the heads of the respective clubs in the approach shot golf club set of the present invention.
Figure 8:
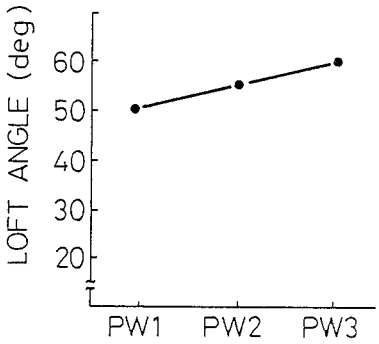
FIG. 8 is a graph showing the loft angles of the respective clubs in the approach shot golf club set of the present invention.

FIG. 6 shows the ball stop properties [(run/carry) $\times$100 (%)] obtained by using the conventional clubs PW1 through PW3. In FIG. 6, the mark "•" shows the ball stop property obtained when a yarn-wound ball is hit, and the mark "o" shows the ball stop property obtained when a two-piece ball is hit. As seen from FIG. 6, when a yarn-wound ball is used, the ball stop property is substantially constant for all the three clubs, but when a two-piece ball is used, the ball stop property is greatly and non-linearly changed with the increase in the club number. Namely, the ratio of the run to the carry is increased in the order of the clubs PW1, PW2, and PW3. Thus, it can be seen that it is difficult to obtain a precise fly distance.

Figure 10:
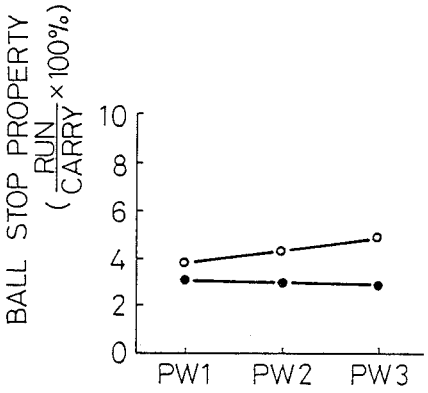
FIG. 10 is a graph showing the ball stop properties obtained by the respective clubs in the approach shot golf club set of the present invention.

FIG. 10 shows the ball stop properties [(run/carry)$\times$100 (%)]obtained by using the clubs PW1 through PW3 of the present invention. In FIG. 10, the mark "•" shows the ball stop property obtained when a yarn-wound ball is hit, and the mark "o" shows the ball stop property obtained when a two-piece ball is hit. As seen from FIG. 10, when a yarn-wound ball is used, the ball stop property is almost constant for all the three clubs, and when a two-piece ball is used, the ball stop property is slightly increased with the increase in the club number, but the quantity of the change is much smaller than in the conventional clubs and the ratio of the change is substantially constant. Accordingly, by using the clubs PW1 through PW3 of the present invention, even if a two-piece ball is used, a precise fly distance can be obtained more easily than when using the conventional clubs PW1 through PW3.

As is apparent from the foregoing description, in the present invention, it is important that in a group of golf clubs having a loft angle larger than 40°, the friction coefficients $\mu$ of face portions of the heads of the respective clubs are determined so that the ball stop properties obtained when a two-piece ball is used are substantially equal or are gradually changed at a small constant ratio for the respective clubs. Thus, an approach shot can be made substantially as precisely as in the case where a yarn-wound ball is used.

Figure 11:
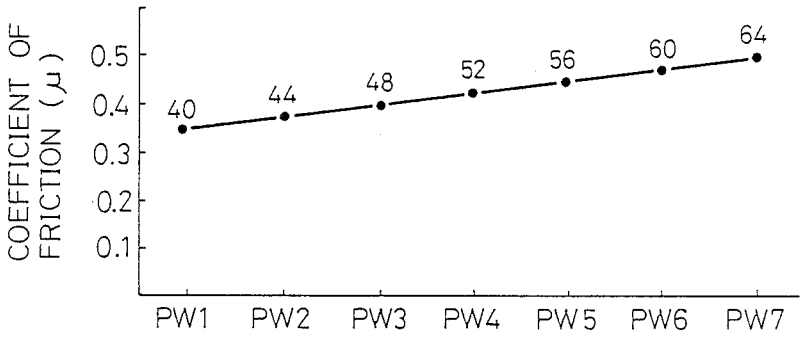
FIG. 11 is a graph showing the friction coefficients and loft angles of the face portions of the heads of the respective clubs in the embodiment wherein the present invention is applied to a golf club set comprising 7 approach shot golf clubs.

FIG. 11 shows the third embodiment of the present invention. In this embodiment, the golf club set comprises seven approach shot clubs PW1 through PW7. As seen from FIG. 11, the friction coefficients $\mu$ of face portions of the heads of the clubs PW1 through PW7 are gradually increased from 0.35 to 0.45 at a substantially constant ratio in accordance with the increase in the club number from PW1. Note, in FIG. 11, the numbers 40 through 64 indicate the loft angle of the corresponding club. In the clubs PW1 through PW7, the loft angle is increased at a constant change ratio in accordance with the increase in the club number. In this embodiment, an appropriate club number suitable for a particular player can be chosen from among the seven clubs. In the present embodiment, the friction coefficients $\mu$ of face portions of the heads of the respective clubs are made larger at a constant ratio in accordance with the increase in the club number. If the friction coefficients $\mu$ of face portions of the heads of the respective clubs are set at values above the line in FIG. 11, better ball stop properties can be obtained.

The present invention is by no means limited to the foregoing embodiments, but various modifications and changes can be made. For example, if the material of a specific club head in the golf club set is different from the material of the other club heads, the friction coefficient of the face portion of the head of this specific club can be made larger than those of the other clubs. Moreover, a face plate composed of a material having a large friction coefficient, such as a ceramic material, may be attached to a club head by bonding or covering. Furthermore, in a golf club set comprising a plurality of golf clubs including a range from long iron clubs to short iron clubs, the friction coefficient of the face portion may be especially increased in some of these golf clubs, preferably golf clubs having a loft angle larger than 40°.

I claim:

1. A set of golf clubs, each golf club in said set having a ball hitting surface, the hitting surfaces of the clubs of said set having gradually increasing loft angles, the hitting surface of the lowest loft angle club in said set having a loft angle larger than 40°, the hitting surfaces of said golf clubs in said set having different coefficients of friction such that said coefficient of friction increases gradually in said golf clubs as the loft angles are increased.

2. A set of golf clubs according to claim 1, wherein said golf clubs in said set have the same club-length.

3. A set of golf clubs according to claim 1, wherein the coefficient of friction of said hitting surface of the lowest loft angle club in said set is not less than 0.35.

* * * * *